US005836460A

United States Patent [19]

Brown et al.

[11] Patent Number: 5,836,460

[45] Date of Patent: Nov. 17, 1998

[54] PORTABLE SPORTS BOTTLE RACK

[76] Inventors: Joe Dan Brown, 2332 State Hwy. 43-E, Henderson, Tex. 75652; Clifford J. Adams, 3400 Varsity Dr., Tyler, Tex. 75701

[21] Appl. No.: 792,637

[22] Filed: Jan. 31, 1997

[51] Int. Cl.[6] ..... A47F 5/00

[52] U.S. Cl. ..... 211/74; 211/75; 211/106; 248/314

[58] Field of Search ..... 211/75, 74, 106, 211/85.7, 88.01; 248/310, 314, 311.2

[56] References Cited

U.S. PATENT DOCUMENTS

| | | | |
|---|---|---|---|
| 2,294,151 | 8/1942 | Wooten et al. | 211/75 X |
| 3,698,563 | 10/1972 | Gordon et al. | 211/85.7 |
| 3,734,439 | 5/1973 | Wintz | 248/314 X |
| 3,921,948 | 11/1975 | Long | 211/75 X |
| 4,049,126 | 9/1977 | Halverson | 211/60.1 X |
| 4,796,762 | 1/1989 | Law | 211/64 |
| 4,944,415 | 7/1990 | Orbach | 211/75 |
| 5,337,907 | 8/1994 | McKenzie et al. | 211/88.01 |
| 5,390,443 | 2/1995 | Emalfarb et al. | 211/88.01 X |
| 5,626,244 | 5/1997 | Mesna et al. | 211/60.1 |

*Primary Examiner*—Robert W. Gibson, Jr.
*Attorney, Agent, or Firm*—Ronald B. Sefrna

[57] ABSTRACT

A portable bottle rack, particularly useful for attachment to a fence or similar vertical structure for the purpose of holding sports bottles, includes a base assembly having two parallel elongate rods, a plurality of bottle holders disposed along and connected to both rods of the base assembly, a plurality of hooks connected to one of the two rods of the base assembly for removably hanging the rack, and a plurality of adjustable straps connected at one end to the other of the two rods, each strap having a releasable hook at its opposite end and a quick release buckle between the two ends, for securing the rack. Utility hooks are also provided to facilitate hanging articles from the rack.

20 Claims, 3 Drawing Sheets

PORTABLE SPORTS BOTTLE RACK

FIELD OF THE INVENTION

The present invention generally relates to the field including racks and compartmented storage devices, and in its preferred embodiments more specifically relates to a portable rack which may be readily and releasably disposed in a convenient location for holding bottles.

BACKGROUND OF THE INVENTION

It is well known that adequate liquid intake during prolonged periods of physical activity is important to the health and well being of those engaged in the physical activity. For participants in athletic activities, especially team sports, water or other liquids have traditionally been made available to team members in a large cooler or other container, from which the liquid is withdrawn into individual cups for consumption. The use of individual cups can create problems with hygiene and disposal. In addition, when a single supply of liquid is used individual team members are not able to accommodate their own preferences for, e.g., the type of liquid they wish to use.

More recently it has been increasingly popular and common for team members to use refillable sports bottles, with each team member having his or her own bottle. The use of individual bottles allows each user to consume the particular liquid he or she prefers, and eliminates the disposal and litter problems associated with the use of individual single use cups. Unfortunately, the use of individual bottles has introduced another set of problems. Each individual becomes responsible for identifying and keeping up with his or her own bottle. As a result, especially in youth athletic activities, bottles are frequently lost or misplaced so they cannot be easily found when needed, are often left on the ground and become contaminated so that the liquid is unfit to consume, or otherwise improperly handled in a number of ways. Coaches, team mothers, etc. often spend an inordinate amount of time and experience great frustration in trying to keep up with bottles and match them to the appropriate user.

There is a continuing need for a portable, easily used means for organizing and securely holding a plurality of bottles while allowing each bottle to be easily removed and replaced in the appropriate holder in the rack structure.

SUMMARY OF THE INVENTION

The present invention provides a lightweight, portable rack structure that is adapted to be easily and quickly attached to and removed from a fence or other suitable support. The rack of the invention includes a plurality of bottle holders designed to securely retain bottles of various sizes and configurations while allowing each bottle to be readily removed and replaced without disturbing adjacent bottles. The attachment means for the rack is designed to facilitate secure attachment of the rack to a fence or other support while allowing quick and easy release and removal of the rack.

The rack of the invention structurally includes a base assembly, a plurality of bottle holders connected to the base assembly, and attachment means for releasably attaching the base assembly to a suitable support. Each bottle holder is formed to receive and retain a bottle in its interior, and generally includes a bottom support upon which the bottom of the bottle is received, a lateral support extending generally upwardly from the bottom support to support the side of a bottle and prevent lateral removal of the bottle, and attachment means for attaching the bottle holder to the base of the rack. In the preferred embodiment each bottle holder is formed as a unitary cage-like structure from heavy wire or metallic rod, but it will be understood that a variety of configurations and construction materials may be used. For example, a cylindrical structure with an open top and closed bottom could be used. Since the bottle rack of the invention is intended to be portable, it is desirable that the bottle holders be of reasonably light weight construction, but with sufficient strength and rigidity to withstand rough handling and transportation without deforming. It is also desirable that the bottle holders only minimally cover or obscure a bottle placed therein, in order to facilitate identification of the correct bottle by a user without the need for a name tag or other separate identification means. The heavy wire construction of the preferred embodiment effectively meets the desired criteria.

The base of the bottle rack generally comprises an elongate, substantially flat assembly that serves the dual purpose of providing a mounting structure for a plurality of bottle holders, and of providing a stable, rigid structure for mounting the rack to a fence. In the preferred embodiment the base of the bottle rack comprises a pair of elongate rods disposed in separated parallel relation, with each bottle holder attached to each of the two rods, mutually interconnecting the primary structural components in a rigid and secure relationship. Alternatives to the parallel rod construction for the base of the rack can be used if desired. For example, an elongate plate formed of wood, metal, or plastic could be used. However, the base should be of light weight, to facilitate handling and transportation of the rack, and should be of sufficiently strength and rigidity to withstand potentially rough use and handling.

The attachment means for releasably connecting the rack to a fence or other structure is a significant aspect of the invention. If the rack is to reliably provide a stable storage location for bottles it should be securely fastened to, most commonly, a fence in such a manner that the rack is not free to move relative to the fence to any significant degree. This is particularly important when the rack is to be attached to a "chain link" or "hurricane" fence, or to a similar type of fence that has an inherent degree of lateral flexibility. In the preferred embodiment of the bottle rack of the invention the attachment means comprises a plurality of hooks connected to the upper rod comprising the base of the rack, and further comprises a plurality of adjustable straps connected at one end to the lower rod of the base of the rack, each strap having a hook connected to its opposite end. To attach the rack to a fence the upper hooks are engaged with the fence so that the rack is disposed horizontally on the fence in the desired position. The adjustable straps are extended, the hooks associated with the straps are engaged with the fence, and the straps are tightened as needed to firmly secure the rack to the fence. To remove the rack, the straps are loosened or released by means of a quick release buckle, the strap hooks are disengaged, and the upper hooks are disengaged so the rack can be lifted from the fence.

The structure and features of the preferred embodiment of the bottle rack of the invention will be described in more detail with reference to the accompanying drawing figures.

DESCRIPTION OF THE PREFERRED EMBODIMENT

Figure 1:
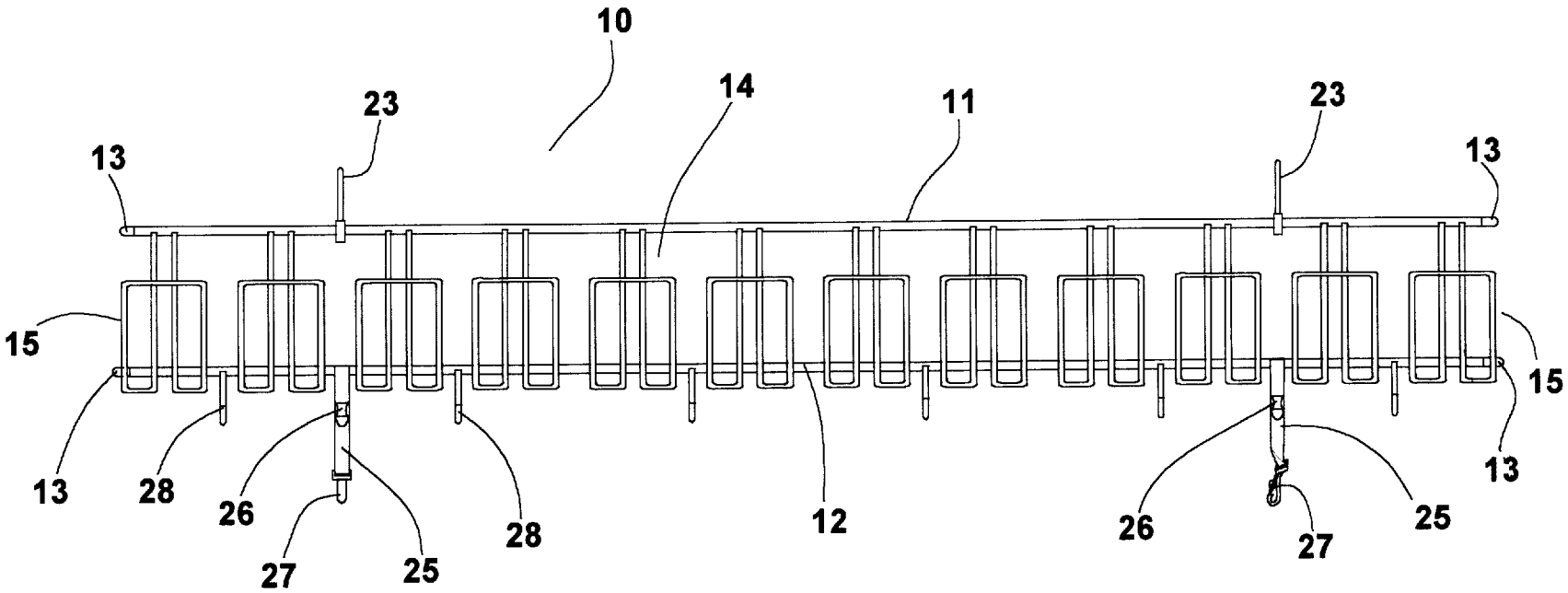
FIG. 1 is a front elevation view of the preferred embodiment of the bottle rack of the invention, in a configuration providing twelve bottle holders.

FIG. 1 illustrates the preferred design of the bottle rack of the invention, provided with twelve bottle holders to retain up to twelve individual bottles, and utilizing a pair of upper hooks and a pair of adjustable quick release straps and hooks as the attachment means for connection of the rack to a fence or other supporting means. The structure shown in FIG. 1 is the preferred structure for the bottle rack of the invention, and it will be understood that the number of bottle holders is not limiting of the invention and may be decreased or increased in accordance with need.

In the accompanying drawing figures, the bottle rack is generally designated by reference numeral 10. In the preferred embodiment the base of the rack comprises two elongate rods of equal length, an upper rod 11 and a lower rod 12, disposed in separated parallel relation. Each rod is preferably provided with a protective tip 13 at each end to cover and cushion the ends of the rods and provide protection against injury or damage from sharp edges. It is preferred that rods 11 and 12 be of circular cross-section, and that they be formed of metal to provide sufficient strength and rigidity at a reasonable cost. However, while not preferred, other configurations and/or other materials of construction may alternatively be used. A nameplate, such as the plate identified in FIG. 1 with reference numeral 14, may be used for identification if desired, but is not a significant structural element of the bottle rack.

Figure 3:
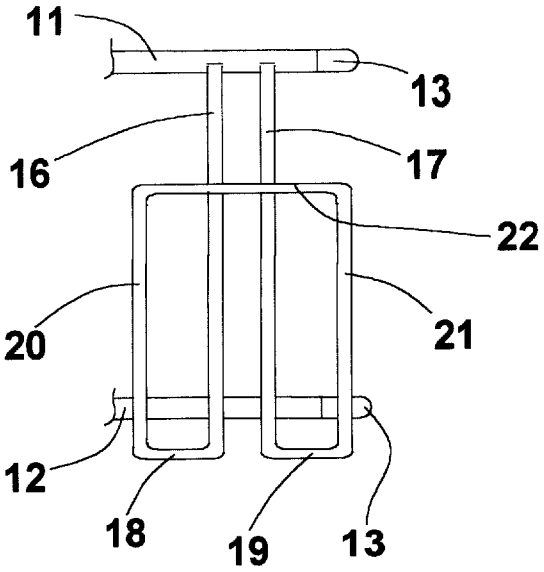
FIG. 3 is a detail of the front elevation view showing the preferred embodiment of the bottle holder component in a front elevation view.
Figure 2:
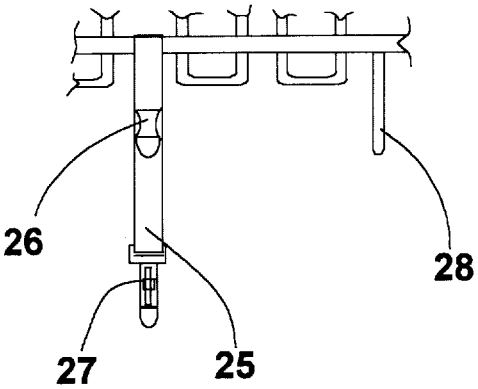
FIG. 2 is a partially sectioned detail of the front elevation view showing an adjustable quick release strap and strap hook, and also showing an optional utility hook.
Figure 5:
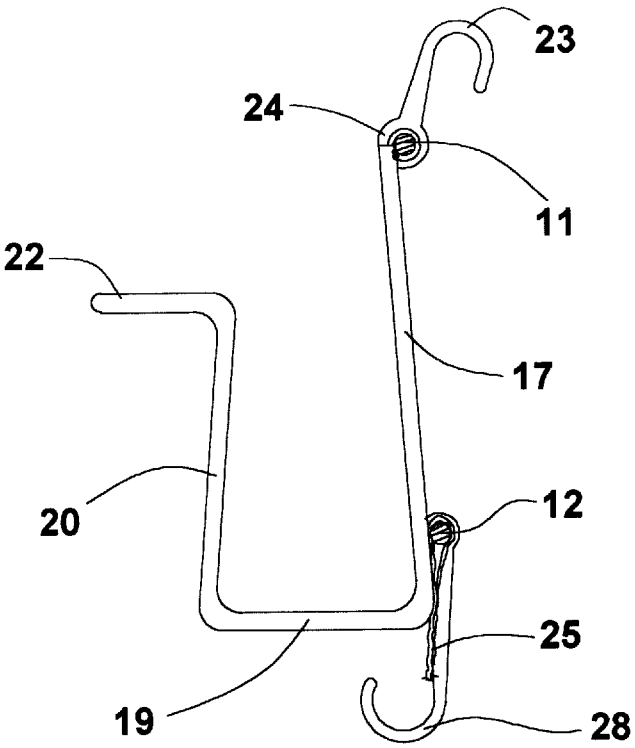
FIG. 5 is a sectioned side elevation view of the bottle rack of the invention, illustrating the preferred embodiment of a bottle holder component, an upper hook, and a portion of an adjustable strap.
Figure 4:
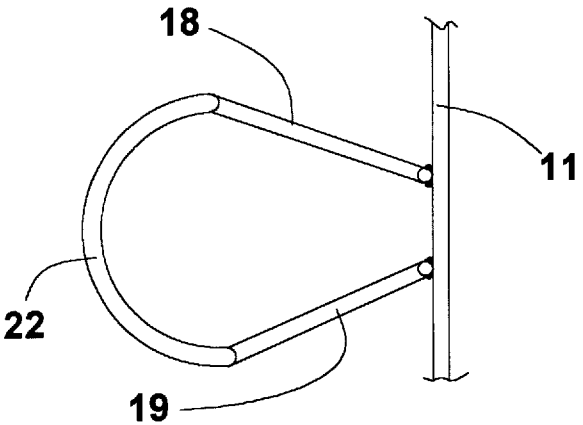
FIG. 4 is a top view of a portion of the bottle rack of the invention, illustrating the preferred embodiment of a bottle holder component.

The bottle rack of the invention further comprises a plurality of bottle holders 15, each designed to receive and retain a sports bottle or the like. In the preferred embodiment of the rack the bottle holders also function to connect upper and lower rods 11 and 12 and contribute to the rigidity and strength of the structure. Each bottle holder 15, as shown in FIGS. 3 through 5, is formed to include a pair of closely spaced parallel legs 16 and 17, sufficient in length to span between upper and lower rods 11 and 12 and extend downwardly below lower rod 12. Legs 16 and 17 are disposed parallel to rods 11 and 12 and are interconnected thereto, forming a connection between rods 11 and 12 as well as connecting the bottle holder to those rods, which form the base of the rack. In the preferred embodiment, legs 16 and 17 bend to form bottom supports 18 and 19 which extend outwardly from the legs to provide a support for the bottom of a bottle. The bottom supports extend generally perpendicular to the legs, with the distance between the bottom supports increasing as they extend outwardly from the legs. The bottom supports then bend to form lateral supports 20 and 21 which extend upwardly from the bottom supports generally parallel to the legs 16 and 17 to laterally support and confine a bottle between them. Lateral supports 20 and 21 are preferably shorter in length than legs 16 and 17, and are connected between their upper ends by a curved retainer ring 22. Retainer ring 22 lies in a plane that is generally parallel to each of rods 11 and 12, and completes the bottle holder structure. It will be readily seen that a bottle may be placed in the holder where it will be supported with its bottom resting on bottom supports 18 and 19 and with lateral supports 20 and 21 and retainer ring 22 preventing lateral removal from the holder. It will also be understood that attachment of a plurality of bottle holders to rods 11 and 12 creates a very sturdy and rigid bottle rack from light weight components.

The preferred attachment means for the bottle rack of the invention comprises a pair of hooks 23 pivotally connected to upper rod 11. As illustrated in FIG. 5, each of hooks 23 includes an eye 24 through which rod 11 extends in loosely fitting relation, so that hook 23 is free to rotate around rod 11 and hook 23 may be slid from side to side along rod 11 between bottle holders. Hooks 23 are disposed to engage, e.g., a fence structure, with rods 11 and 12 extending along and in contact with the fence. At least two hooks are required to support the bottle rack in stable relation to the fence, and additional hooks may be provided if desired.

The attachment means also includes a pair of elongate flexible straps 25 connected at one end to lower rod 12, with each of straps 25 independently adjustable in length. It is preferred that straps 25 be provided with adjustment buckles 26, and it further preferred that buckles 26 be of a quick release, snap-together design to facilitate disconnection of the straps and removal of the rack. A strap hook 27 is connected to the opposite end of each strap, for connection to a fence or the like. Strap hooks 27 may be open hooks similar to hooks 23, but preferably include a closure means to facilitate attachment to a wire fence.

In addition to the attachment hooks for connection of the rack to a fence or other support, it is preferred that the bottle rack also include a plurality of utility hooks connected to lower rod 12 to allow articles such as caps, gloves, jackets, etc. to be hung from the rack. As illustrated in FIG. 1, utility hooks may be disposed on rod 12 between bottle holders.

The bottle rack of the invention may be quickly and easily attached to and removed from a fence. To attach the rack, hooks 23 are hooked into the fence structure at the desired location. Straps 25 are extended and strap hooks 27 are connected to the fence structure at any convenient point below the rack. Straps 25 are then tightened to firmly secure the rack to the fence. When use of the rack is completed, straps 25 are released, preferably by releasing buckles 26, the strap hooks 27 are removed from the fence, and buckles 26 are reconnected if a releasable buckle is used. The rack may then be lifted from the fence as hooks 23 are disengaged, completing the removal.

Although the foregoing description has referred to the portable bottle rack of the invention primarily in terms of attachment to a fence, it should be understood that the usefulness of the rack is by no means limited thereby. The portable bottle rack may be advantageously used by mounting it on any structure to which it can be attached. For example, the portable rack may easily be mounted on a flat wall to which mounting eyes have been attached to receive hooks 23 and 27. The portable rack may be temporarily mounted on the side of a vehicle, as another example. The structure of the rack is also susceptible to various modifications and to the use of alternative embodiments within the scope of the invention as defined by the following claims.

We claim:

1. A portable bottle rack, comprising an elongate base assembly having an upper edge and a lower edge;

first attachment means for releasably connecting said upper edge of said base assembly to a supporting structure;

second, flexible, attachment means for releasably connecting said lower edge of said base assembly to a supporting structure; and a plurality of bottle holders disposed on said base assembly and interconnected thereto, each of said bottle holders having an open top to receive a bottle therethrough, bottom support means to support a bottle thereon, and lateral support means to laterally retain a bottle placed in said bottle holder.

2. The portable bottle rack of claim 1, wherein said elongate base assembly includes a pair of elongate rods disposed in separated parallel relation, and a plurality of interconnecting means connected between said pair of elongate rods.

3. The portable bottle rack of claim 2, wherein each of said bottle holders further includes a pair of legs interconnected to and extending upward from said bottom support means in generally perpendicular relation thereto, and wherein said interconnecting means comprise said legs.

4. The portable bottle rack of claim 1, wherein said base assembly comprises an elongate upper rod and an elongate lower rod, disposed in separated parallel relation, wherein each of said bottle holder includes a pair of legs interconnected to and extending from said bottom support means, with each of said legs connected between said upper rod and said lower rod, and wherein said first attachment means comprises a plurality of hooks pivotally connected to said upper rod and said second attachment means comprises a plurality of elongate adjustable length straps connected to said lower rod.

5. The portable bottle rack of claim 4, wherein each of said straps has a first end and a second end, with each of said straps is connected to said lower rod at said first end of said strap, and wherein each of said straps further includes a strap hook interconnected to said second end of said strap.

6. The portable bottle rack of claim 5, wherein each of said straps is formed in two parts, releasably interconnected by a quick release buckle disposed between said first and second ends of said strap.

7. The portable bottle rack of claim 6, wherein the length of each of said straps is adjustable at said quick release buckle.

8. The portable bottle rack of claim 2, wherein each of said bottle holders further includes a pair of elongate legs disposed in generally parallel relation and interconnected between said pair of rods of said base assembly to form said interconnecting means, said bottom support means comprises a pair of rods each extending outwardly from a different one of said legs in generally perpendicular relation thereto, said lateral support means comprises a pair of rods each extending upwardly from a different one of said rods of said bottom support means, and wherein each of said bottle holders further includes a retainer ring extending between said rods of said lateral support means in generally perpendicular relation thereto.

9. The portable bottle rack of claim 8, wherein each of said bottle holders is formed from a single elongate rod by bending.

10. The portable bottle rack of claim 1, further including a plurality of utility hooks connected to said base assembly to facilitate the hanging of various articles therefrom.

11. A portable bottle rack to be releasably connected to a substantially vertical fence for supporting a plurality of bottles therein, comprising an elongate base assembly to be connected to said fence, said base assembly having an upper edge and a lower edge;

a plurality of hooks interconnected to said upper edge of said base assembly for connecting said upper edge of said base assembly to said fence;

a plurality of variable length straps, each having a first end and a second end, with each of said straps connected at said first end thereof to said lower edge of said base assembly and releasably connectable to said fence at said second end thereof, for connecting said lower edge of said base assembly to said fence and;

a plurality of bottle holders disposed along and interconnected to said base assembly, each of said bottle holders adapted to receive and releasably retain a bottle therein with said base assembly connected to said fence.

12. The portable bottle rack of claim 11, wherein said base assembly comprises a pair of elongate rods disposed and interconnected in generally parallel relation.

13. The portable bottle rack of claim 11, wherein said base assembly comprises an elongate plate.

14. The portable bottle rack of claim 11, wherein said base assembly generally defines a plane, and wherein each of said bottle holders includes a pair of legs, each having a first end and a second end, and each connected to said base assembly in generally parallel relation to said plane thereof;

a pair of bottom supports, each having a first end and a second end, and each connected at said first end to said second end of a different one of said legs with said bottom supports in generally perpendicular relation to said legs;

a pair of lateral supports, each having a first end and a second end, and each connected at said first end to said second end of a different one of said bottom supports in generally perpendicular relation to said bottom supports; and a retainer ring interconnected between said second ends of said lateral supports.

15. The portable bottle rack of claim 14, wherein said base assembly includes a pair of elongate rods disposed in separated parallel relation, and wherein said legs of said bottle holders are connected between said elongate rods of said base assembly.

16. The portable bottle rack of claim 11, wherein each of said straps includes a releasable hook at said second end thereof.

17. The portable bottle rack of claim 11, wherein each of said straps includes a quick release buckle disposed between said first end and said second end thereof.

18. The portable bottle rack of claim 14, wherein each of said bottle holders is formed from a single elongate metal rod by bending, said rod having a first end and a second end, with said first end of one of said legs being said first end of said rod and with said first end of the other of said legs being the second end of said rod.

19. The portable bottle rack of claim 11, further comprising a plurality of utility hooks interconnected to said lower edge of said base assembly between ones of said bottle holders.

20. A portable bottle rack, comprising an elongate base assembly having a longitudinal axis;

attachment means interconnected to said base assembly for releasably connecting said base assembly to a supporting structure, said attachment means being longitudinally adjustable relative to said base assembly; and a plurality of bottle holders disposed on said base assembly and interconnected thereto, each of said bottle holders having an open top to receive a bottle therethrough, bottom support means to support a bottle thereon, and lateral support means to laterally retain a bottle placed in said bottle holder.

* * * * *